United States Patent [19]

Plant

[11] Patent Number: 4,848,439

[45] Date of Patent: Jul. 18, 1989

[54] METHOD OF COUNTERGRAVITY CASTING

[75] Inventor: Lawrence B. Plant, Milford, Mich.

[73] Assignee: General Motors Corporation, Detroit, Mich.

[21] Appl. No.: 191,468

[22] Filed: May 9, 1988

[51] Int. Cl.[4] ..... B22D 18/06; B22C 7/02; B22C 9/12

[52] U.S. Cl. ..... 164/16; 164/34; 164/63

[58] Field of Search ..... 164/63, 16, 255, 34, 164/35, 36

[56] References Cited

U.S. PATENT DOCUMENTS

| | | | |
|---|---|---|---|
| 3,780,787 | 12/1973 | Rasmussen | 164/255 |
| 4,085,790 | 4/1978 | Wittmoser | 164/7.1 |
| 4,340,108 | 7/1982 | Chandley et al. | 164/63 |
| 4,566,521 | 1/1986 | Uzaki et al. | 164/160.1 |
| 4,616,689 | 10/1986 | Denis | 164/34 |
| 4,632,171 | 12/1986 | Almond | 164/255 |

OTHER PUBLICATIONS

U.S. Ser. No. 096,663 (9/15/87), referred to on p. 1 of the specification.

U.S. Ser. No. 191,544 (5/9/88), referred to on pp. 3, 4, and 5 of the specification as Attorney docket No. P-302.

*Primary Examiner*—Kuang Y. Lin

*Attorney, Agent, or Firm*—Lawrence B. Plant

[57] ABSTRACT

In the mold-immersion type countergravity casting method, a resin-bonded particulate mold is formed in-situ in the vacuum chamber used to draw melt into the mold by: providing the chamber with a porous wall; positioning a gasifiable pattern in the chamber; embedding the pattern in a mass of mold-forming particulate containing a chemically curable precursor of the resin binder; and passing a curing gas through the porous wall and mass to cure the resin and unify the mass about the pattern. Thereafter, the mold is immersed in an underlying pool of molten metal and a vacuum drawn in the chamber to displace the pattern in the mold with metal.

5 Claims, 4 Drawing Sheets

METHOD OF COUNTERGRAVITY CASTING

This invention relates to mold-immersion type countergravity casting processes and more specifically to such processes wherein resin-bonded particulate molds therefor are formed directly in the casting apparatus.

BACKGROUND OF THE INVENTION

The so-called "lost foam" process, involves pouring molten metal into a foamed plastic pattern surrounded by a porous, unbonded said mold. The molten metal vaporizes the pattern and replaces it in the sand before the sand collapses. The solidified metal thus assumes the shape of the foamed plastic pattern and the pattern destruction products escape into the porous mold. The "lost foam" process has been proposed for use in conjunction with both gravity and countergravity poured metal as exemplified by Wittmoser, U.S. Pat. No. 4,085,790, issued Apr. 25, 1987 and Denis, U.S. Pat. No. 4,616,689, issued Oct. 14, 1986, respectively.

Copending U.S. patent application Ser. No. 096,663, entitled "Casting Metal in a Flowable Firmly Set Sand Mold Cavity", filed Sept. 15, 1987, now U.S. Pat. No. 4,754,798, in the name of G. D. Chandley, describes a cating process wherein a disposable pattern (e.g., wax, foam, etc.) is embedded in a lightly-bonded, self-supporting, sand mold having sufficient porosity to receive liquid and vapors generated upon destruction of the pattern. Low temperature heating of the mold/pattern, prior to casting, causes the pattern to become fluid and wick into the pores of the sand mold as well as flow out of the gate and sprue openings in it. Thereafter, metal is cast into the mold using either gravity or countergravity techniques.

The mold-immersion, countergravity casting process, is described in U.S. patent, Chandley et al U.S. Pat. No. 4,340,108, inter alia, and involves sealing a porous, gas-permeable mold in the mouth of a vacuum chamber, immersing the underside of the mold in an underlying molten metal pool and evacuating the chamber to draw molten metal through one or more ingate(s) in the underside of the mold into one or more mold cavities formed within the mold. Chandley et al's mold comprises a rigid, self-supporting, particulate (e.g., sand) mass formed by a shell molding process wherein resin binders (i.e., thermosets) are used to bind the particles together. One such shell molding process is described in U.S. patent, Almond U.S. Pat. No. 4,632,171. Low temperature chemical-curing techniques may alternatively be used to bond the particulates together and commercial systems therefor (e.g., Isocure$^R$, Alphaset$^R$, Betaset$^R$, or Iroset$^R$ processes) are available wherein a bonding resin-precursor-containing particulate is exposed to a promoter (e.g., a catalyzing or reactive gas) to form the binder resin that hold the particles together. In Chandley et al U.S. Pat. No. 4,340,108, a two-part mold (i.e., cope and drag) is formed in separate operations, glued together, and then transferred as a unit to the casting site. These operations require not only separate and costly mold forming and handling equipment, but also consume valuable plant floor space, increase the risk of mold damage and add labor content to the process.

Finally, copending United States patent application Ser. No. 191,544, filed May 9, 1988, entitled "Countergravity Metal Casting", filed concurrently herewith in the name of G. D. Chandley and assigned to the assignee of this invention, describes a mold-immersion type contergravity casting process wherein an inherently unstable mass of particulates (i.e., with or without a small amount of binder) form the mold and are held about a vaporizable pattern in the casting chamber of the Chandley et al (i.e., U.S. Pat. No. 4,340,108) type by a pressure differential established between the chamber and the exposed under surface of the mold. Molten metal drawn up into the mold vaporizes and displaces the pattern therein.

It is an object of the present invention to provide an improved method for making molds for mold-immersion type countergravity casting processes, which method eliminates the need for separate mold-making, mold-joining and mold-transfer equipment and associated floor space and labor heretofore required to make molds for such processes. It is another object of the present invention to provide an improved method for making molds for the mold-immersion type countergravity casting process which method more closely integrates the mold-making and casting operations so as to provide a more continuous process and the economies associated therewith. These and other objects and advantages of the present invention will become more readily apparent from the detailed description thereof which follows.

BRIEF DESCRIPTION OF THE INVENTION

The present invention is an improvement on the mold-immersion type countergravity casting process and comprehends essentially forming and during the mold in-situ in the vacuum chamber used during the casting step rather than in a separate operation.

The improved process is similar to other mold-immersion type countergravity casting processes in that it involves the principal steps of: (1) positioning a porous, resin-bonded particulate (i.e., preferably silica or zirconia foundry sand) mold in the mouth of an open-ended container defining a vacuum chamber, which mold has a molding cavity therein and gate(s) in the underside thereof for admitting metal into the cavity; (2) immersing the underside of the mold, and its associated gate(s), into an underlying pool of molten metal; (3) drawing a vacuum in the chamber sufficient to draw the metal from the pool through the gate(s) and into the cavity; (4) removing the metal-filled mold from the pool; and (5) discharging the mold from the chamber after the metal therein has substantially solidified.

In accordance with the improvement of the present invention however, the mold is both formed and cured in-situ in the selfsame container as defines the vacuum chamber used during the casting step. The container is provided with a porous, gas-permeable wall, ala U.S. Ser. No. 191,544 supra, spaced from the mouth of the container to provide a chamber between the wall and the mouth for receiving mold-forming particulates containing chemically curable binder-forming precursors. The pores in the wall are generally smaller than the grains of particulate such that gas can freely pass through the wall but particulates cannot enter and plug the wall so as to prevent the passage of gas therethrough. A gas plenum is provided on the backside of the wall, i.e., opposite the particulate-containing chamber side of the wall. The container is first oriented such that its mouth faces upwardly to receive mold-forming particulates dispensed therein. A tempoary, removable upstanding frame-like rim, ala Ser. No. 191,544 supra, is provided at the mouth of the container to effectively increase the depth of the particulate-receiving chamber and thereby provide means for shaping a mass of particulates into a mold portion which protrudes out of the chamber beyond the mouth of the container as will be described hereinafter in more detail. A gasifiable pattern, of the type commonly used in the "lost foam" process (e.g., polystyrene foam), is then positioned in the chamber (i.e., between the porous wall and the mouth of the container) and enveloped by a mass of mold-forming particulate material as by blowing, pluviation, fluidization, vibration or combinations thereof as is well known in the practice of embedding patterns in the "lost-foam" process. The mold-forming particulate is mixed with a chemically curable precusor of the resin used to bond the particulates together. The particulates are preferably coated with the precursor. After the pattern has been properly embedded in the particulate bed and in accordance with the present invention, a curing gas is passed through the porous wall of the container and through the particulate bed to catalyze or react (i.e., depending on the chemistry of particular resin system used) with the curable precursor of the resin binder therein. Sufficient curing gas is passed to convert the precursors into the bonding resin for holding the particulates together in a unified bonded mass surrounding the pattern. The temporary rim is then removed from the mouth of the container to leave a free-standing portion of the unified mass protruding beyond the mouth of the container. Next the container is inverted to position the protruding portion of the mold beneath the container mouth and immediately above an underlying pool of molten metal. The protruding portion of the mold is then immersed in an underlying pool of molten metal, and sufficient vacuum drawn behind the porous wall (i.e., on the opposite side of the mold) to reduce the pressure in the chamber and draw molten metal from the pool into the mold cavity. The molten metal drawn into the mold gasifies (e.g., vaporizes) and displaces the pattern therein. At the same time, the gasification products generated by the destruction of the pattern are sucked from the molding cavity throuh the porous mold material to substantially prevent the formation of entrapped gas voids in the casting.

DETAILED DESCRIPTION OF A SPECIFIC EMBODIMENT

The present invention will be better understood when considered in the light of the following detailed description of a specific embodiment thereof which is given hereafter in conjunction with the several drawings which depict the several stages of the process and wherein.

Figure 1:
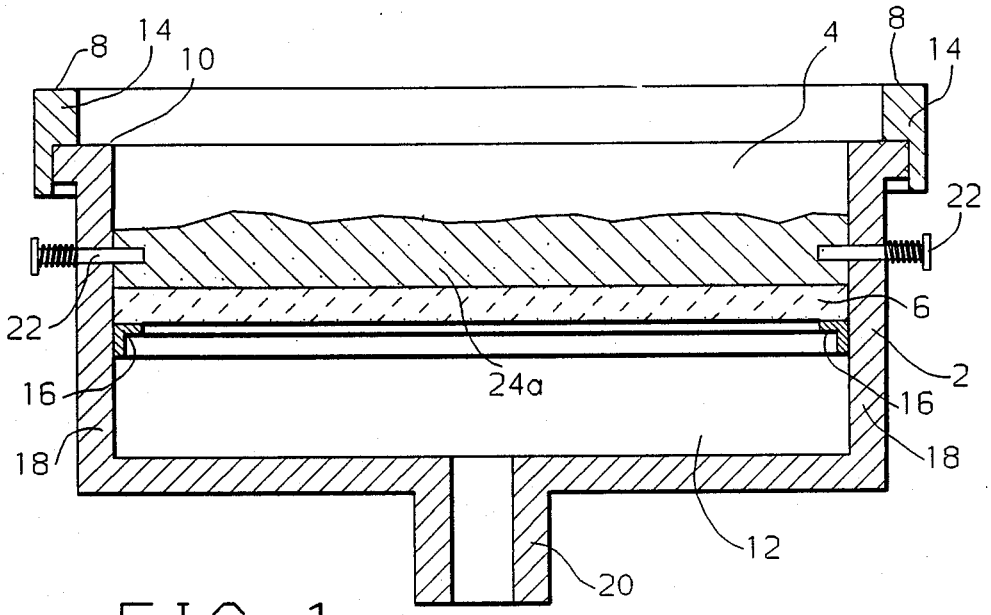
FIG. 1 is a sectioned elevational view of the casting container oriented to receive mold-forming particulates.

The several Figures show an open-ended container 2 divided into a mold-forming and retaining chamber 4 and a gas plenum 12 by a porous, gas-permeable wall 6. A temporary, removable rim 14 is positioned atop the mouth 10 of the container 2 so as to effectively increase the depth of the chamber 4 and extend it beyond the mouth 10 to permit ready formation of a mold portion which protrudes outboard the mouth 10 of the container 2 as will be described in more detail hereinafter. The porous wall 6 may comprise sintered metal, ceramic frit, microporous diffuser plate/screen, or the like, and is detachably secured to an annulr shelf 16 affixed to the inside of the walls 18 forming the container 2. A duct 20 communicates with a gas plenum 12 and is connected to sources of vacuum or pressurized gas (i.e., curing, fluidizing or discharging as appropriate) through an appropriate valving arrangement (not shown). Spring-biased retractable retainer pins 22 may be provided through the walls 18 to retain the mold in the chamber 4 and insure that it does not accidentally become dislodged when the container 2 is in the inverted position (i.e., open and down).

Processwise, the container 2 is initially oriented with its mouth 10 facing upwardly as shown in FIG. 1. An initial layer of mold-forming particulate 24*a* is preferably dispensed into the chamber 4 onto the porous wall 6. The particulates will preferably comprise foundry sand (e.g., silica, zirconia, etc.) which is coated with an art-known precursor of the resin binder to be formed therein to hold the particulates together. Hence, the precursors may comprise: a mixture of phenolic and isocyanate resins which are subsequently cross-linked by passing a catalyzing amine vapor (e.g., triethanolamine) therethrough to form a phenolic-urethane binder; a phenolic resin which is subsequently reacted with methylformate gas passed therethrough to form a phenolic-ester resin binder; or a mixture of acrylic epoxy resin, hydroperoxide and silane which is subsequently cured by passing $SO_2$ gas therethrough. Molds made directly in the vacuum chamber 4, in accordance with the present invention, need not have as much particular or binder content as molds made in separate operations and subsequently transferred to the casting site. In this regard, the additional strength/durability provided by more particulates or higher binder content in molds subjected to more handling is not required when making the molds in-situ in the casting chamber for direct casting therein. Lower particulate and resin content reduces the cost of the mold-forming materials. Moreover, lower resin content (i.e., compared to commercially available mold-forming sands—Isoset$^R$, Isocure$^R$, etc.) improves flowability of the particulates and results in a more porous mold for the more effective removal of the pattern decomposition products from the molding cavity during the casting operation. Commercial resin loadings may, of course, also be used.

Figure 2:
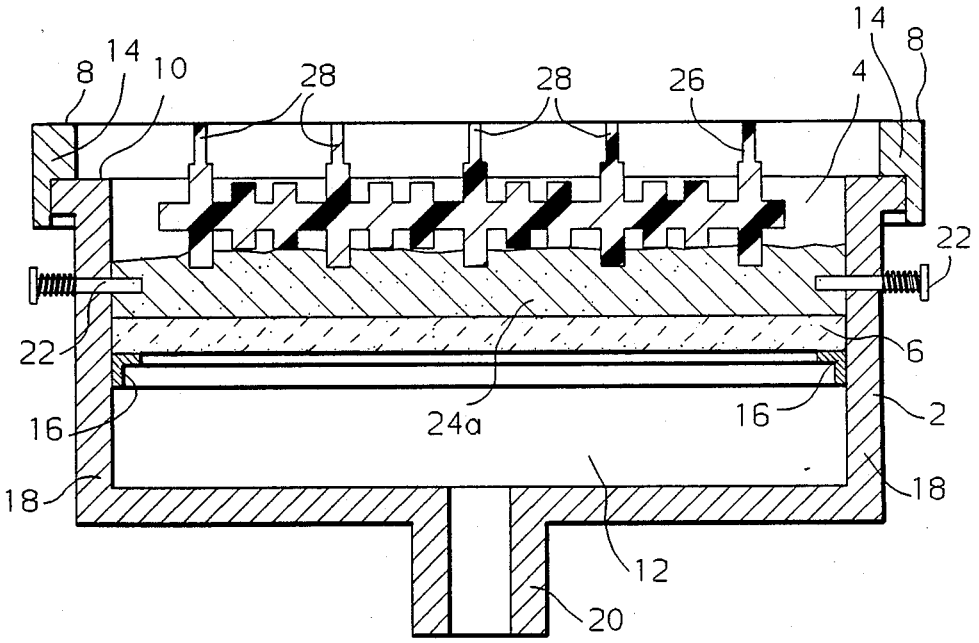
FIG. 2 is a view similar to FIG. 1 following positioning of a pattern in the container.
Figure 3:
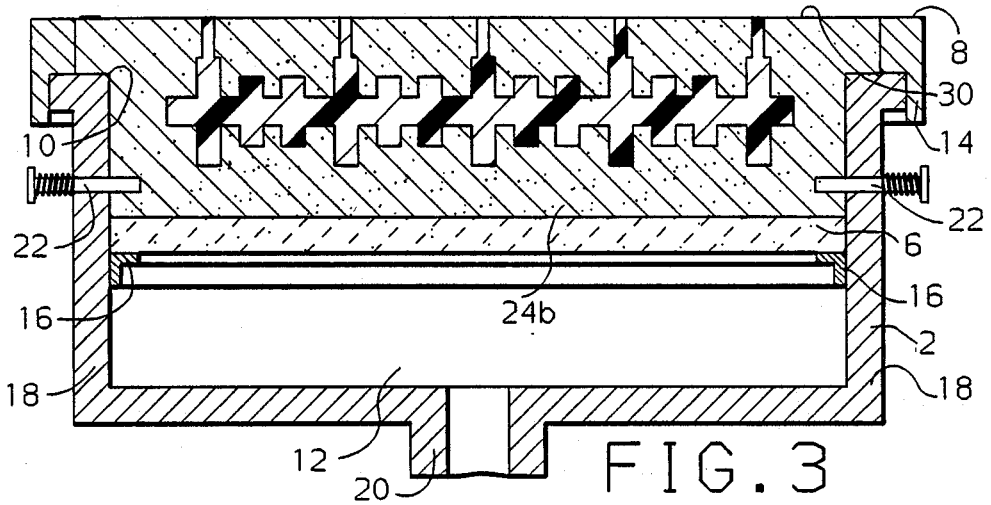
FIG. 3 is a view similar to FIG. 2 following embedment of the pattern in the mold-forming particulate.

As best shown in FIG. 2, a gasifiable pattern 26 (e.g., polystyrene foam) is partially set into, the initial particulate layer 24*a*. The pattern 26 will preferably include a plurality of gate-forming projections 28 extending therefrom which serve to shape the ingates to the molding cavity which is shaped by the remainder of the pattern 26. Appropriate means or fixtures, not shown, may be employed to hold the pattern 26 in position in the chamber section 4 during subsequent operations. Following the initial setting of the pattern 26 in the sand layer 24*a*, additional particulate 24*b* is dispensed into the chamber 4, the rim 14 and around the pattern 26, as best shown in FIG. 3. The gate-forming projections 28 of the pattern 26 extend to the exposed surface 30 of the mold-forming particulate 24 which itself is flush with the upper surface 8 of the temporary rim 14.

Figure 4:
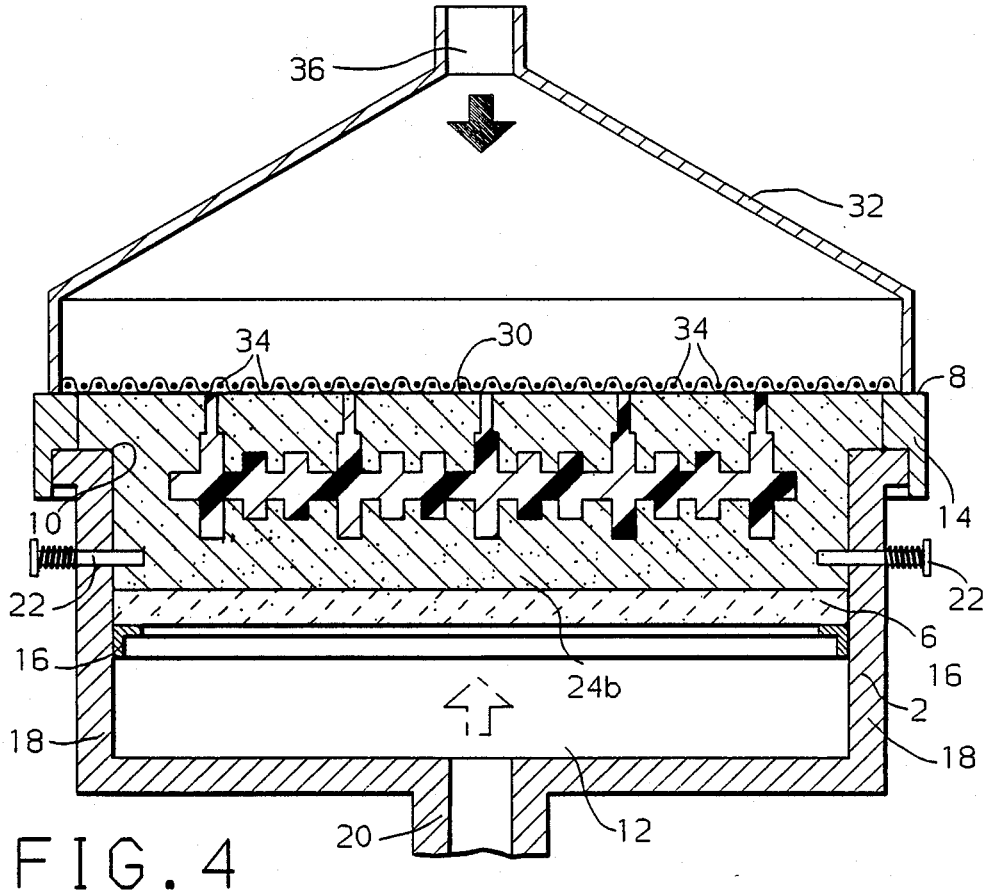
FIG. 4 is a view similar to FIG. 3 during gas curong of the mold-forming particulate.

After the pattern 26 has been completely embedded in the mold-forming particulate 24, the particulate-filled container is transferred to a curing station (see FIG. 4) which includes a hood 32 having a screen 34, or porous material similar to that comprising wall 6, on the lower end thereof for engaging the upper surface 30 of the particulate mass 24. The screen 34 is sufficiently fine as to distribute the curing gas substantially evenly throughout the particulate mass 24 during the curing operation. The hood 32 includes an appropriate duct 36 for introducing curing gas into the hood 32. At the curing station, a curing gas (e.g., catalyst or reactive) is admitted to hood 32 via duct 36 from whence it subsequently passes through the particulate mass 24, the porous, gas-permeable wall 6, and into the plenum 12 before exhausting through the duct 20 to the atmosphere or appropriate air cleaning equipment (e.g., scrubbers, etc.—not shown) as may be needed. Alternatively, (shown in phantom in FIG. 4), the curing gas may be admitted to the particulate mass 24 via the plenum 12 and wall 6 and exhausted therefrom via the hood 32. In this mode the screen 30 serves the additional function of preventing passage of mold-forming particulates into the hood 32 and duct 36.

Figure 5:
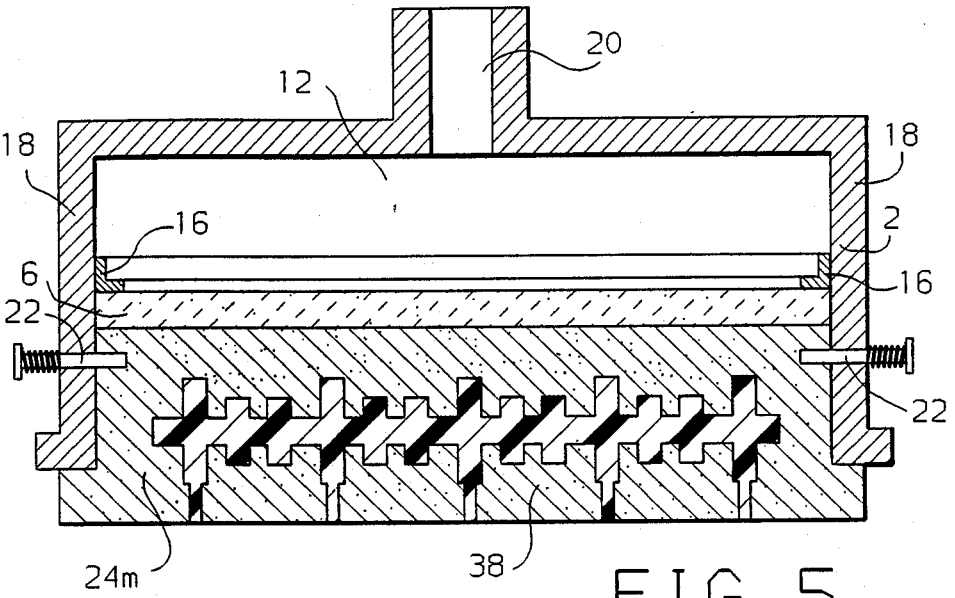
FIG. 5 is a sectioned elevational view of the mold and container of FIG. 4 after gassing and inverted preparatory to immersion into the melt.
Figure 6:
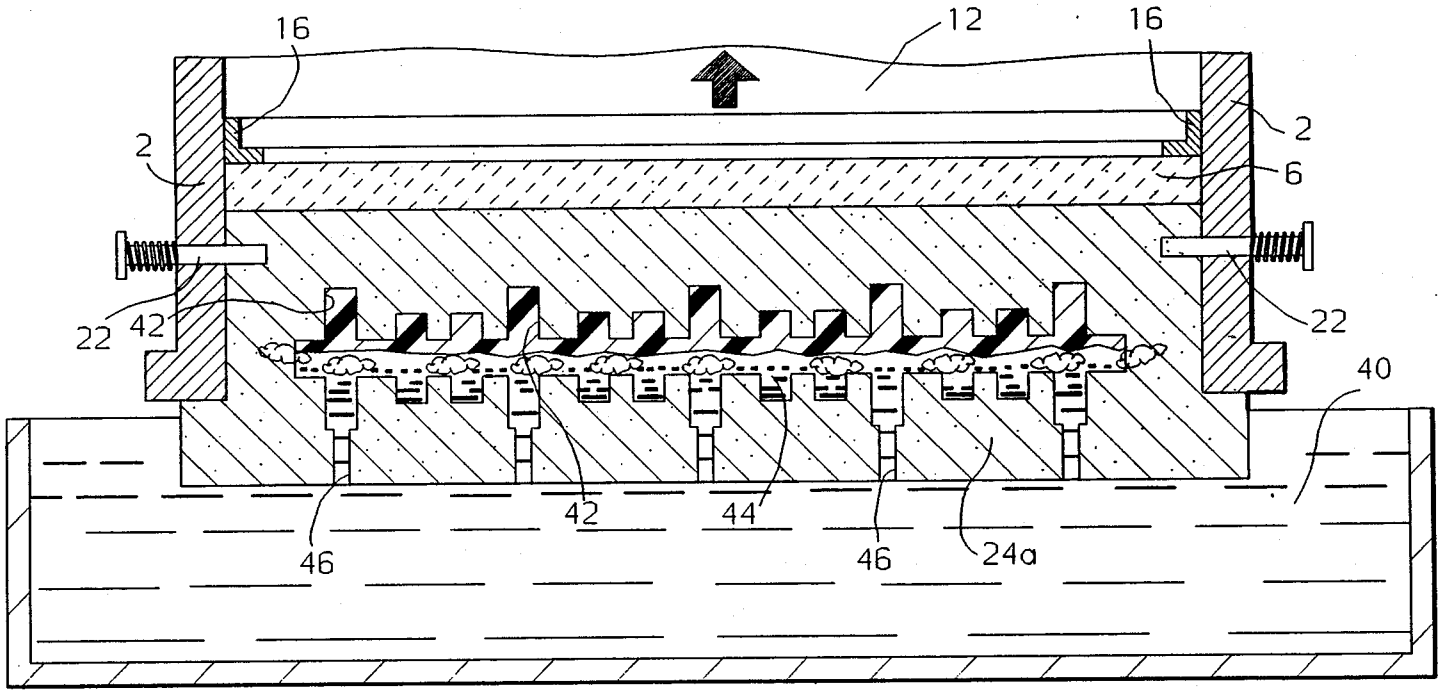
FIG. 6 is a view similar to FIG. 5 after immersion of the mold into the metal melt.

Following curing of the resin binder and consequent unification of the particulate mass 24 into mold **24*m*, the rim 14 is removed from the mouth 10 of the container 2 leaving a portion of the mold 38 (see FIG. 5) protruding from the mouth 10 of the container 2 and adapted for immersion into a pool of metal melt. The container 2 is then inverted such that the protruding mold portion 38 underlies the container 2 as best shown in FIG. 5. As best shown in FIG. 6, the protruding portion 38 of the mold is then immersed in a pool 40 of molten metal and a vacuum drawn in plenum 12 to draw the molten metal up into the mold cavity 42 formed by the pattern 26. As the molten metal 44 flows through the ingates 46 and into the cavity 42, the pattern 26 gasifies ahead of the metal front and the gasious products formed therein, incident to the gasification of the pattern 26, are sucked out of the mold cavity 42 through the interstitial pores of the mold 24*m* by the vacuum in the plenum 12**.

Figure 7:
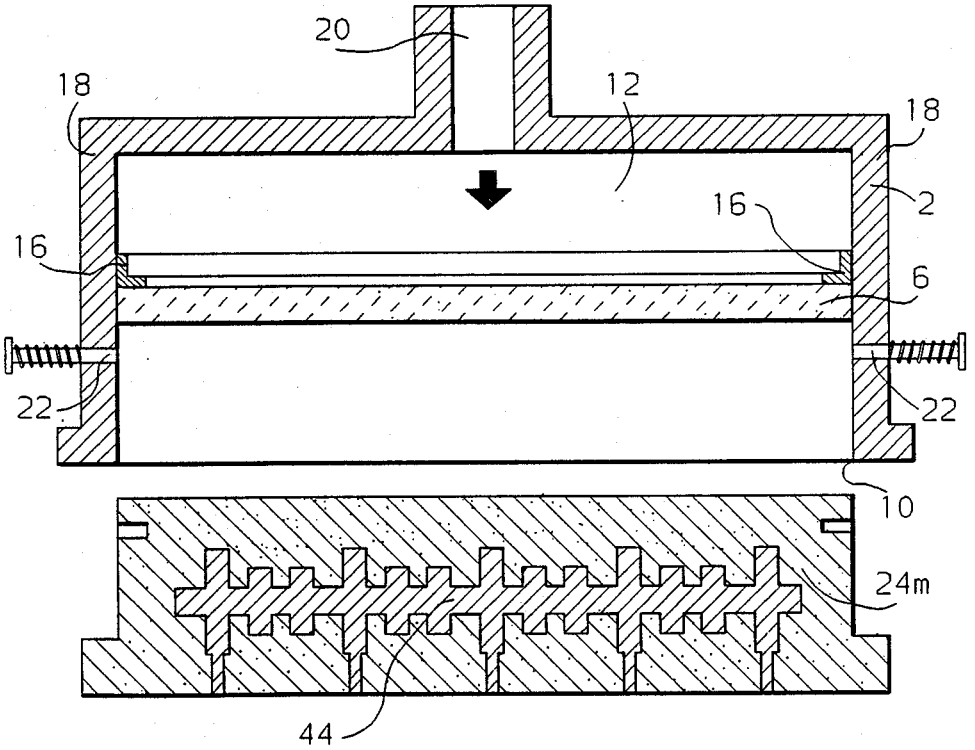
FIG. 7 depicts the metal-filled mold of FIG. 6 being pneumatically ejected from the container.

Finally, and as best shown in FIG. 7, after the metal 44 in the mold cavity 42 has solidified sufficiently, the mold **24*m* is discharged from the container 2 and the cycle repeated. More specifically, the retainer pins 22, if used, are retracted and pressurized air admitted to the plenum 12 to blow the mold 24*m* free of the chamber 4 in container 2**.

While the invention has been disclosed primarily in terms of a specific embodiment thereof it is not intended to be limited thereto but rather only to the extent set forth hereafter in the claims which follow.

The embodiments of the invention in which an exclusive property or privilege is claimed are defined as follows:

1. In the process for the vacuum countergravity casting of metal comprising the principal steps of positioning a porous, resin-bonded particulate mold in the mouth of a container defining a vacuum chamber, said mold defining a cavity for receiving and shaping molten metal therein and having at least one gate in the underside thereof for admitting said metal into said cavity, immersing said underside and gate(s) into an underlying pool of molten metal, drawing a vacuum in said chamber sufficient to draw said molten from said pool into said cavity, removing the metal-filled mold from said pool, and discharging said mold from said chamber after the metal therein has substantially solidified, the improvement comprising:

providing said container with a porous, gas-permeable wall spaced from said mouth and separating said chamber from a gas plenum on the backside of said wall;

orienting said container with its mouth facing upwardly;

positioning a gasifiable pattern in said chamber for shaping said cavity;

embedding said pattern in a mass of mold-forming particulate containing a chemically curable precursor or said resin, said mass at least in part protruding beyond said mouth to provide an immersible mold portion upon curing;

passing sufficient curing gas through said wall and mass to form said bonding resin from said curable precursor and to bond said particulate together in said chamber and portion;

orienting said container such that said immersible portion underlies said chamber; immersing said portion in said pool; and applying said vacuum in said plenum to (1) draw said metal into said cavity and therewith gasify and displace said pattern therein, and (2) remove the pattern gasification products from said cavity through said porous mold.

2. The process according to claim 1 wherein said particulate comprises foundry sand.

3. The process according to claim 2 wherein said curing gas catalyses the curing of said precursor.

4. The process according to claim 2 wherein said gas reacts with said precursor.

5. The process according to claim 1 including the step of applying superatmospheric pressure behind said wall to effect said discharging.

* * * * *